US007870771B2

(12) United States Patent
Mueller et al.

(10) Patent No.: US 7,870,771 B2
(45) Date of Patent: Jan. 18, 2011

(54) LOCK DEVICE WITH A LOCK CYLINDER AND A KEY

(75) Inventors: Ulrich Mueller, Velbert (DE); Matthias Habecke, Hattingen (DE); Dirk Jacob, Heiligenhaus (DE)

(73) Assignee: Huf Hulsbeck & Furst GmbH & Co. KG, Velbert (DE)

( * ) Notice: Subject to any disclaimer, the term of this patent is extended or adjusted under 35 U.S.C. 154(b) by 280 days.

(21) Appl. No.: 11/991,617

(22) PCT Filed: Aug. 12, 2006

(86) PCT No.: PCT/EP2006/008004

§ 371 (c)(1),
(2), (4) Date: Jul. 21, 2008

(87) PCT Pub. No.: WO2007/028483

PCT Pub. Date: Mar. 15, 2007

(65) Prior Publication Data

US 2009/0266123 A1 Oct. 29, 2009

(30) Foreign Application Priority Data

Sep. 7, 2005 (DE) ..... 10 2005 042 618

(51) Int. Cl.
*E05B 19/06* (2006.01)
*E05B 29/04* (2006.01)

(52) U.S. Cl. ..... 70/409; 70/492

(58) Field of Classification Search ..... 70/409, 70/405–407, 492–495, 419, 421, 358, 365, 70/366, 376, 377, 392, DIG. 37
See application file for complete search history.

(56) References Cited

U.S. PATENT DOCUMENTS 1,244,450 A * 10/1917 Christoph ..... 70/492

(Continued)

FOREIGN PATENT DOCUMENTS

DE 897 215 11/1953

(Continued)

*Primary Examiner*—Lloyd A Gall
(74) *Attorney, Agent, or Firm*—Lucas & Mercanti, LLP; Klaus P. Stoffel

(57) ABSTRACT

A lock device having a key and a lock cylinder. The lock cylinder includes a fixed cylinder housing and a cylinder core mounted to rotate therein. The key shaft (10.3) has an edge profile and may be inserted in a key way of the cylinder core in which displaceable tumblers (41, 42) are located transverse to the above. The key shaft (10.3) has profiled recesses running in the longitudinal direction. The recesses have a pair of follow points for each tumbler (41, 42) for coding the key, whilst the tumbler (41. 42) has a pair of counter follow points which are the basis of the corresponding counter coding. A space-saving design of the lock device is achieved with a large range of variation for the coding wherein both follow points are on the key shaft (10.3) in the form of recesses, arranged on opposing lateral surfaces to an edge (57.2; 57.3) of the edge profile of the key shaft (10.3). A web (22: 23) is thus generated in the corner region of the edge profile between both recesses. The web functions as a code web (22; 23), as the opposing web edges serve for the coding. The corresponding tumblers (41, 42) have a cut-out, which in use enclose the code web (22; 23) on opposing web edges. The lateral limits of the cut-out form the counter follow points in the tumblers (41, 42).

39 Claims, 8 Drawing Sheets

U.S. PATENT DOCUMENTS

| | | | | | |
|---|---|---|---|---|---|
| 2,030,837 | A | * | 2/1936 | Full et al. | 70/401 |
| 2,123,940 | A | * | 7/1938 | Gray | 70/492 |
| 2,641,125 | A | * | 6/1953 | Oroquieta | 70/423 |
| 2,690,665 | A | * | 10/1954 | Oroquieta | 70/492 |
| 3,035,433 | A | * | 5/1962 | Testa | 70/495 |
| 3,648,493 | A | * | 3/1972 | Geisler | 70/375 |
| 4,357,815 | A | * | 11/1982 | Kleefeldt et al. | 70/337 |
| 4,440,010 | A | * | 4/1984 | Guiraud | 70/409 |
| 5,235,832 | A | | 8/1993 | Lux et al. | |
| 6,145,357 | A | * | 11/2000 | Stefanescu | 70/406 |
| 6,799,447 | B2 | * | 10/2004 | Mielonen et al. | 70/366 |
| 7,690,232 | B2 | * | 4/2010 | Klein et al. | 70/409 |
| 2006/0000251 | A1 | * | 1/2006 | Ceron et al. | 70/492 |

FOREIGN PATENT DOCUMENTS

| | | |
|---|---|---|
| DE | 199 44 070 | 4/2001 |
| EP | 0 267 316 | 5/1988 |
| FR | 883 755 | 7/1943 |

* cited by examiner 10.1
11
17
57.1
12
70
21
14
19
13
18
73

10.2
22
24
21
30.3

71
57.2
30.1
57.1
30.2
17
30.4
57.4
72

LOCK DEVICE WITH A LOCK CYLINDER AND A KEY

This application is a 371 of PCT/EP2006/008004 filed Aug. 12, 2006, which in turn claims the priority of DE 10 2005 042 618.2 filed Sep. 7, 2005, the priority of both applications is hereby claimed and both applications are incorporated by reference herein.

BACKGROUND OF THE INVENTION

The invention concerns a lock device. A lock device of this type is disclosed by DE 199 44 070 C2. In that lock device, the coding of the key consists of a coding groove that extends in the longitudinal direction of the key. The corresponding tumblers have projections to serve as scanning points, and, when the key is inserted, each of these projections fits into a certain cross section of the coding groove. The position of the projection on the tumbler depends on the coding of the groove and thus constitutes the corresponding countercoding of the lock device.

EP 0 267 316 A1 describes a different lock device, in which the bit of the key has a polygonal cross section. Notches of different depths are formed on the edges of the bit. Spring-loaded tumbler pins engage the edges of the key bit and scan the depth of the notches in the corner regions of the key bit. At the tip of the key bit, bevels are provided on the lateral surfaces between the edges to raise the tumbler pins when the key is inserted.

SUMMARY OF THE INVENTION

The objective of the invention is to find a reliable lock device with a new coding possibility. An important goal of the coding is to develop a key which has a small cross section but is nevertheless distinguished by a large range of variation of codings.

The invention creates the coding in the corner regions of the edge profile of the key bit. The pair of scanning points is produced by two recesses proceeding in opposite directions from each other in adjacent lateral surfaces of the edge profile. A web is left in the corner region of the edge profile between the two angular cutouts. In successive axial sections of the code web, opposite web flanks are offset from each other in pairs and produce the pairs of scanning points of the key bit, which in this way serve for coding. For this reason, this web can be called a "code web". The course of the code web is determined by the corner region of the edge profile. Because the two web flanks of the code web can, if necessary, also extend beyond the edge of the edge profile of the key bit, we obtain, with a small key cross section, a large range of variation in the arrangement of the two opposite web flanks of the code web that serve for coding. Because the two web flanks are enclosed by the lateral boundaries of a cutout in the tumblers, positive guidance is provided. This positive guidance has an advantage in lock devices in which the key acts only as an emergency key and therefore is used only in exceptional cases. When a key is used only in emergencies, the tumblers in the cylinder core can become tight or sticky due to long disuse. The positive guidance of the invention ensures smooth movement of the tumblers. In an emergency key of this type, the lock device is normally controlled by electric remote control or by a smart card.

Because the edge profile of the key bit usually has several edges, e.g., it has a rectangular design, a code web of the invention can be located in each of the corner regions. At least some of these code webs can have a coding that differs from the others in order to realize a large range of variation of the lock device of the invention.

In addition, protection against being forced open is increased, because the cooperating scanning points of the tumblers engage different code webs and therefore can be displaced in different directions in the cylinder core relative to each other. This makes it more difficult for unauthorized persons to get a grasp of how the lock device can be forced open. This also makes it more difficult to use picking tools to decode the code.

The invention is explained below with reference to several specific embodiments illustrated in the drawings.

FIGS. 1*a* and 1*b* show perspective views of a first and a second embodiment of the key bit of the invention.

Figures 1A, 1B:
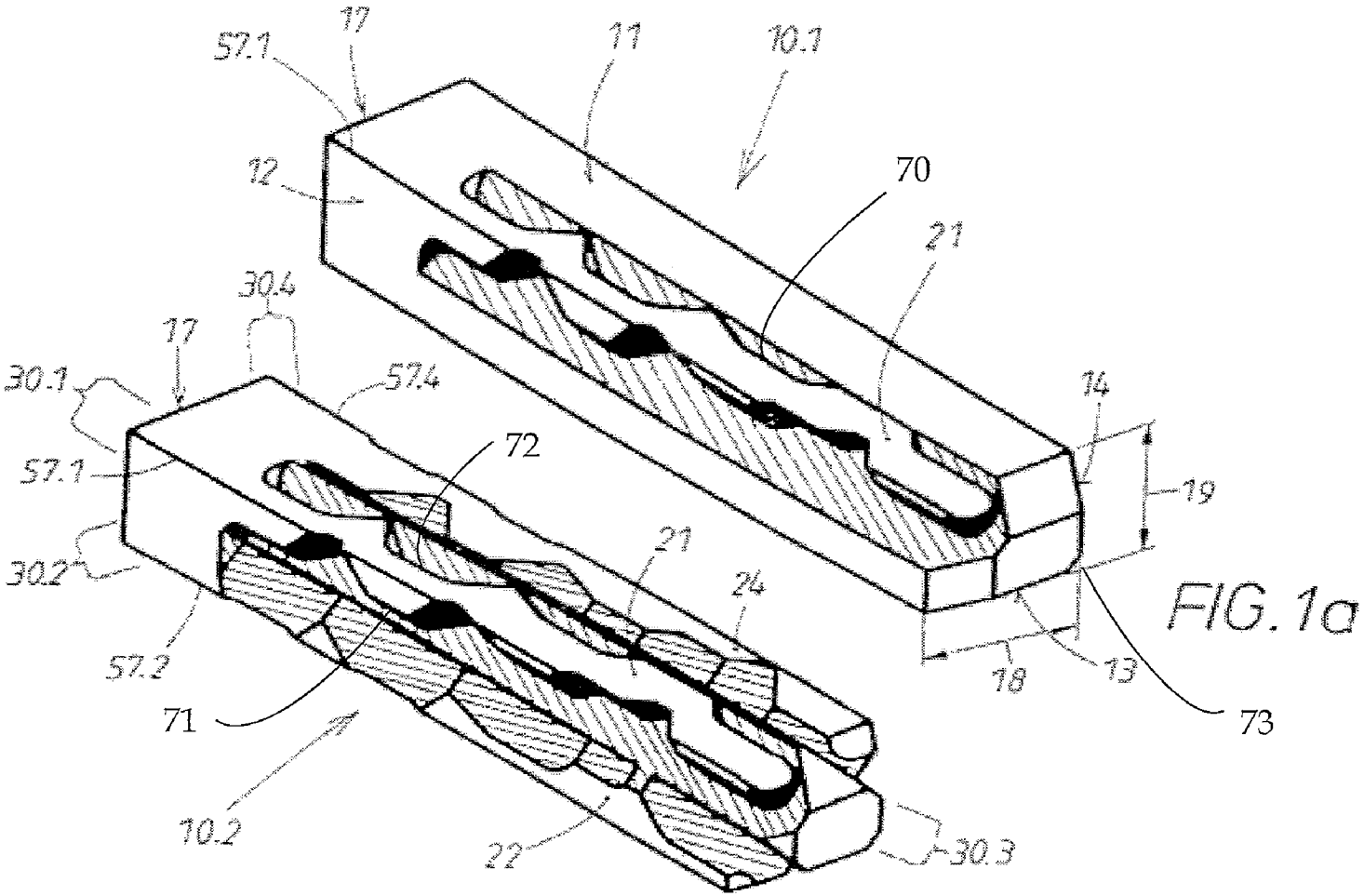
Figure 5B:
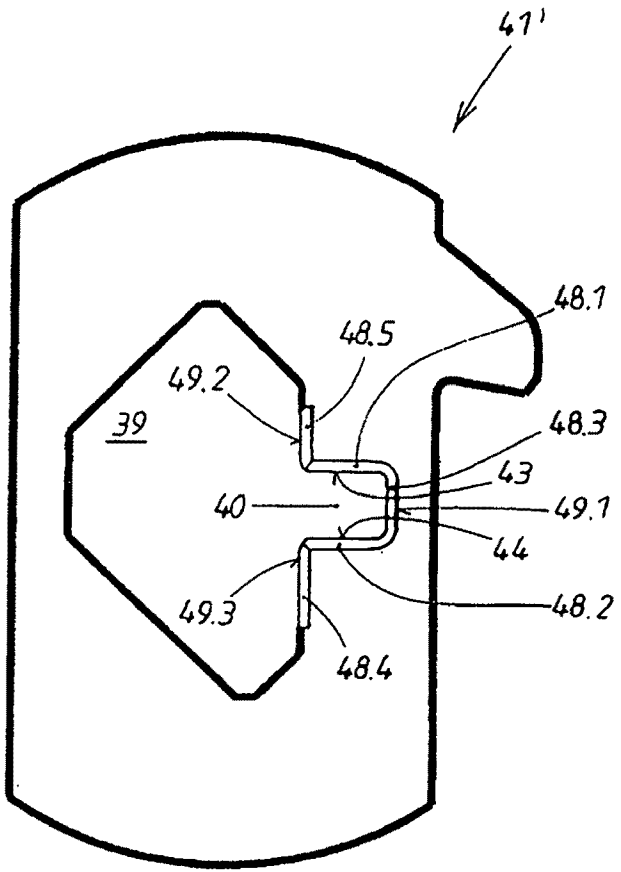
Figure 5A:
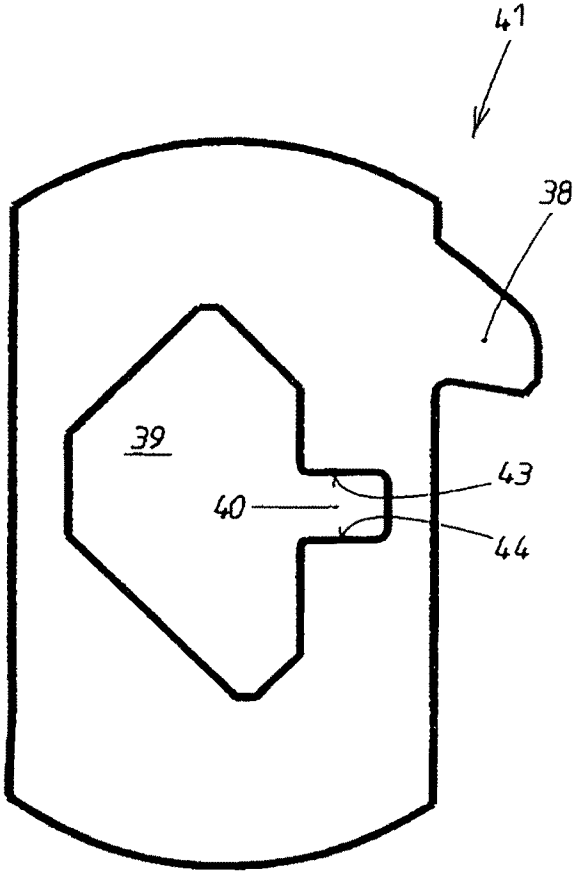

FIGS. 5*a* and 5*b* show top views of two specific embodiments of a practical tumbler, which is assigned to a specific pair of scanning points in the key of FIGS. 1*a* and 1*b*.

Figure 6:
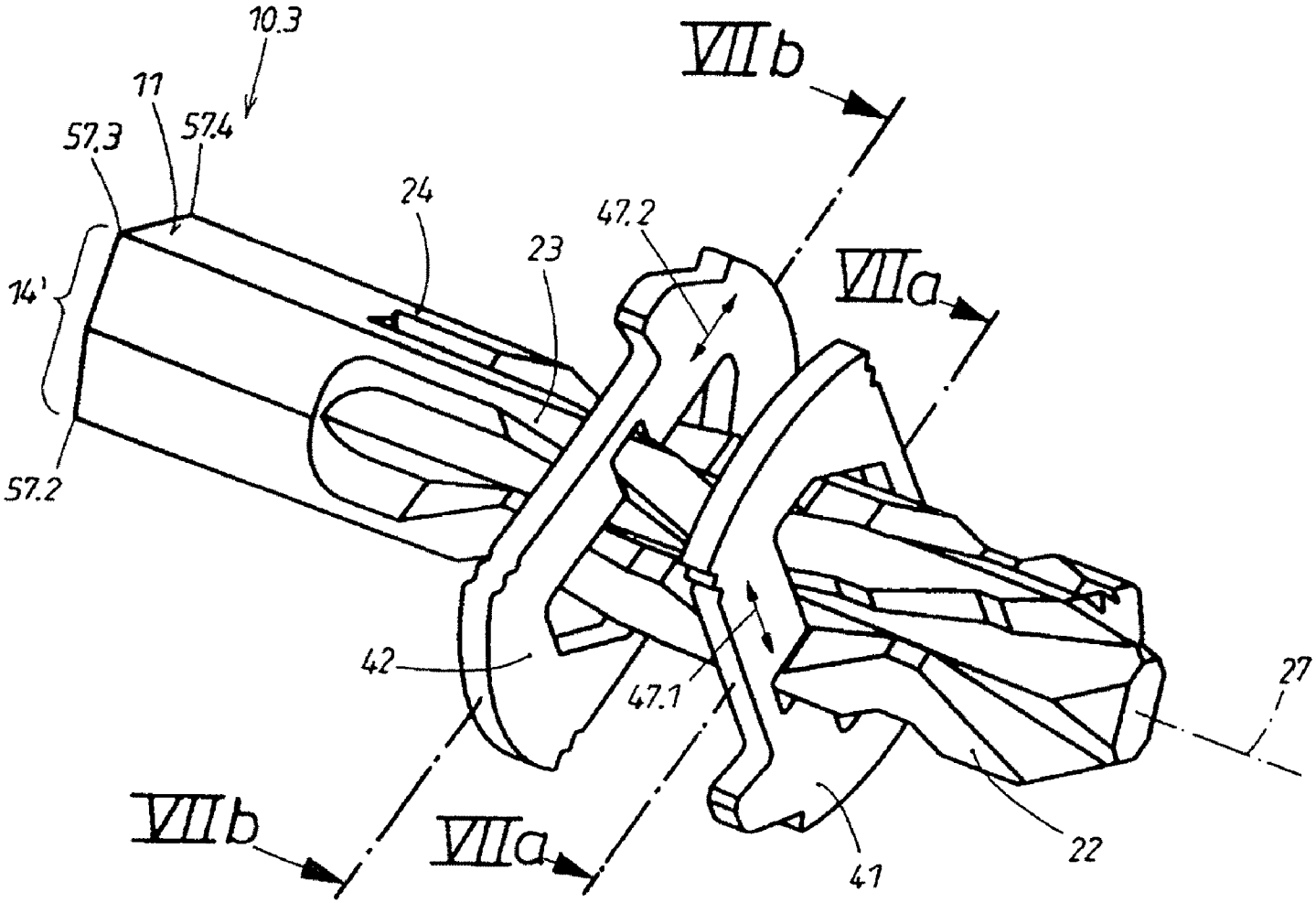

FIG. 6 shows a perspective view of a third specific embodiment of a key bit of the invention with two tumblers, which act on two code webs that are different from each other.

Figure 7B:
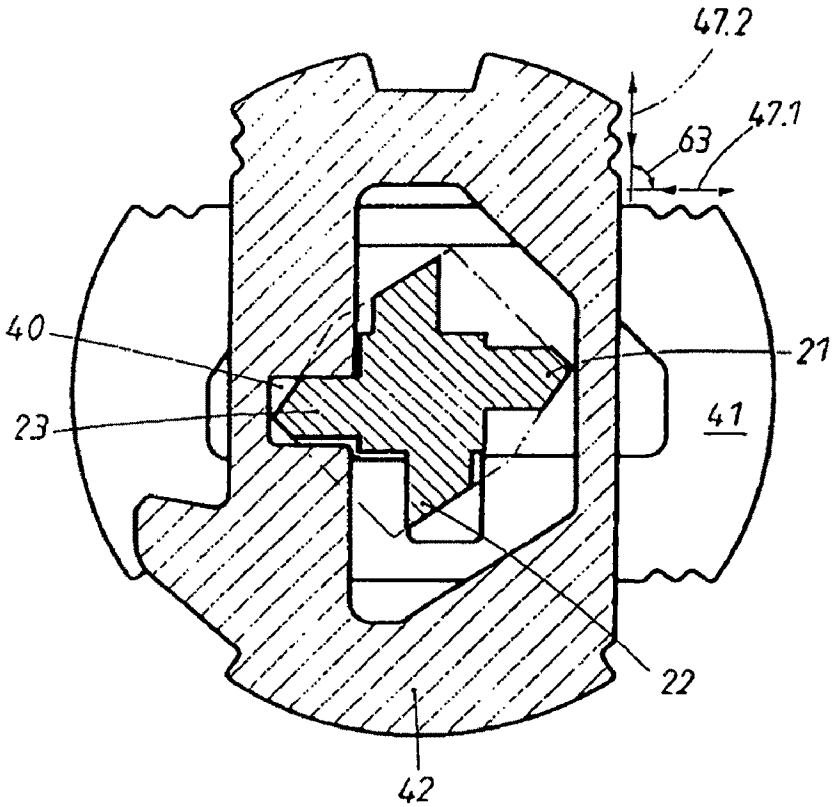
Figure 7A:
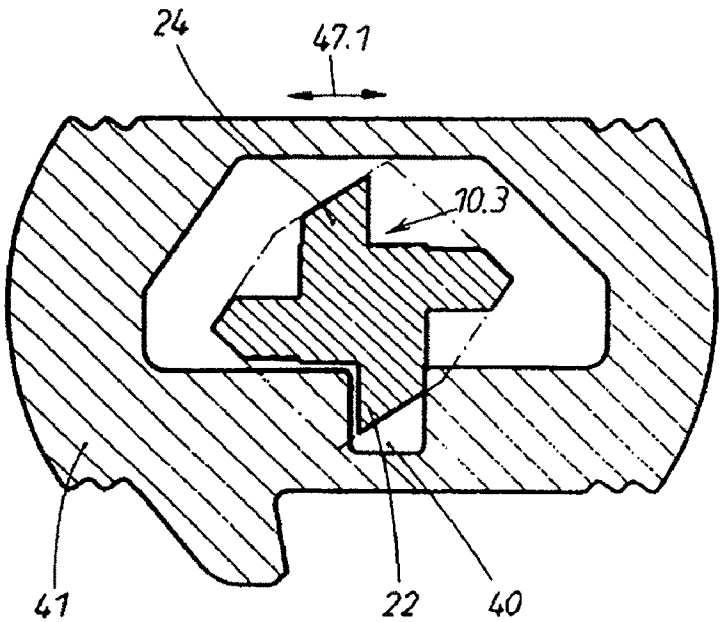

FIGS. 7*a* and 7*b* show two enlarged cross sections through the key bit shown in FIG. 6 along the sectional planes VIIa-•-VIIa and VIIb-•-VIIb in FIG. 6.

Figure 7C:
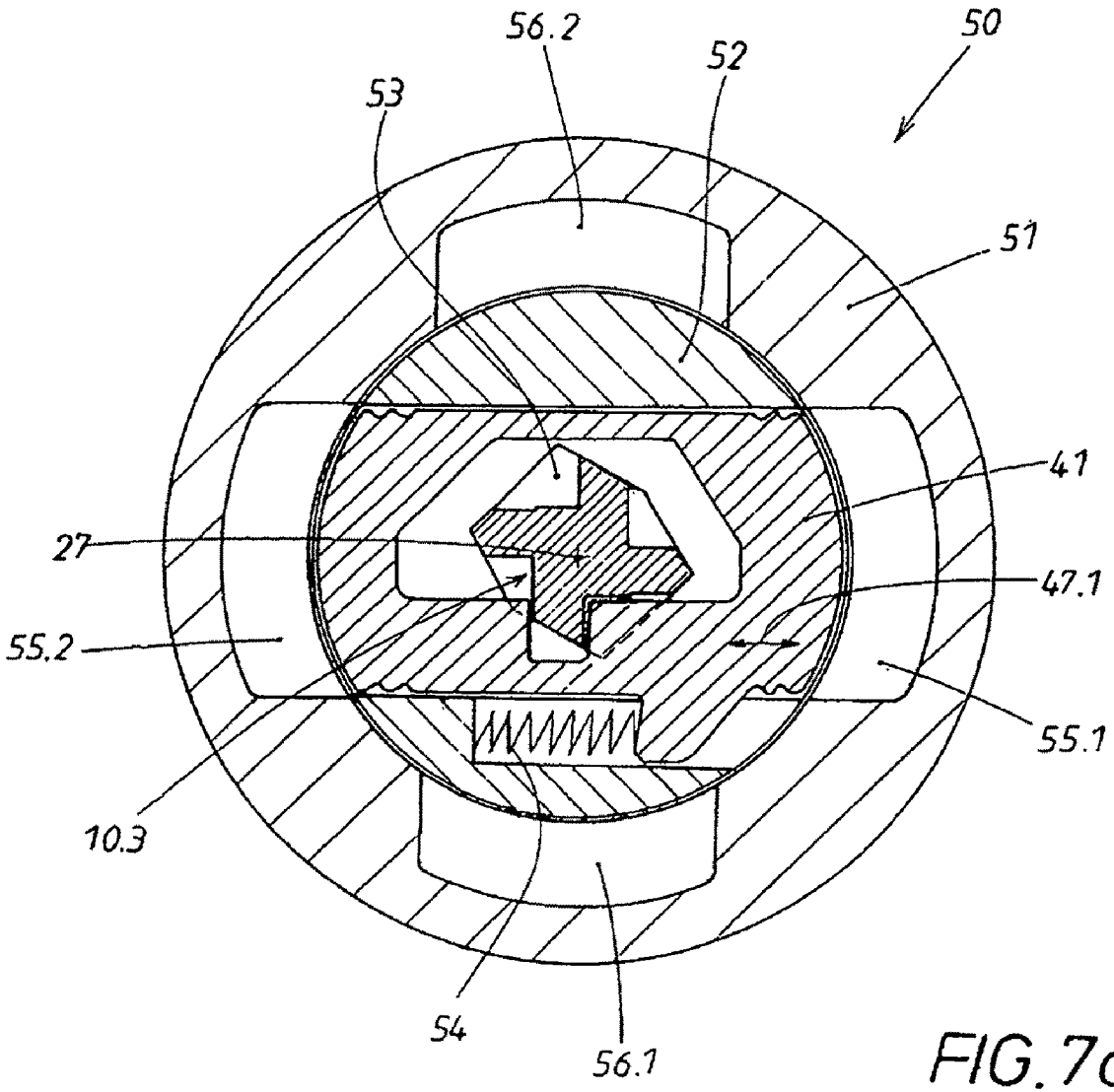

FIG. 7*c* shows a cross section through a complete lock device of the invention with a lock cylinder and a key bit.

Figure 8:
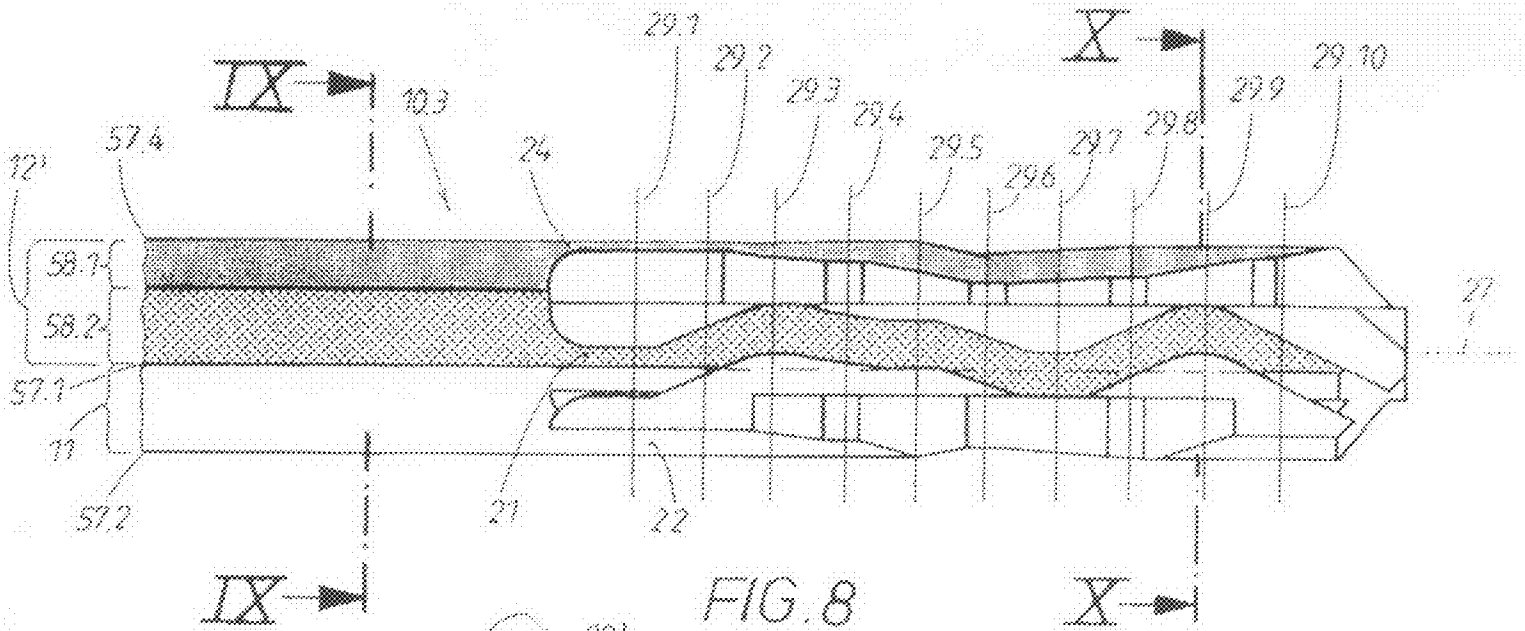

FIG. 8 shows a top view of the key bit already shown in FIG. 6.

Figure 10:
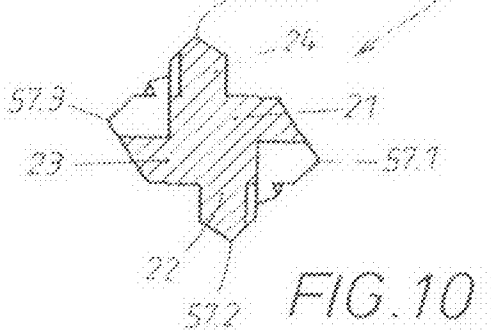
Figure 9:
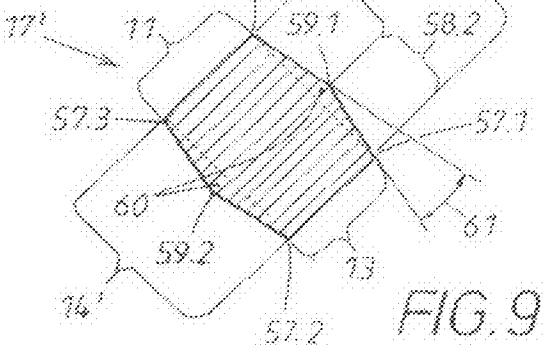

FIGS. 9 and 10 show two cross sections through the key bit of FIG. 8 along the sectional planes IX-•-IX and X-•-X.

DETAILED DESCRIPTION OF THE INVENTION

FIG. 1 shows a first embodiment 10.1 of a key bit, which has an edge profile 17. This edge profile 17 has a rectangular design and has only one code web 21 in the area of one of the edges 57.1. The perspective drawing shows two lateral surfaces 11, 12. The rectangular profile has different edge dimensions, because the width 18 is greater than the profile height 19.

FIG. 1*b* shows a second embodiment 10.2 of a key bit, whose edge profile 17 is also a rectangle, but in this case, all of the corner regions 30.1 to 30.4 are provided with code webs 21 to 24, three of which (21, 22, 23) can be seen. The design of code webs of this type will be explained in greater detail with reference to FIGS. 2 and 3.

Figure 3:
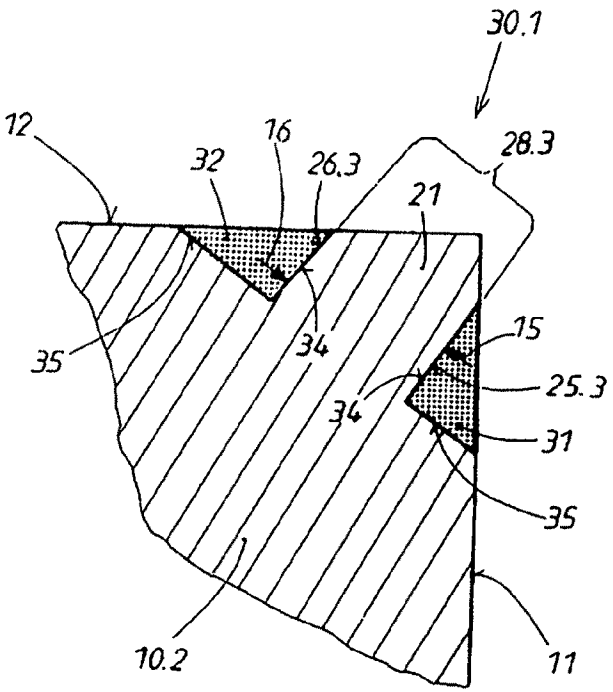
FIG. 3 shows a practical cross section through the key bit with a pair of scanning points, one on each side of the code web.
Figure 2:
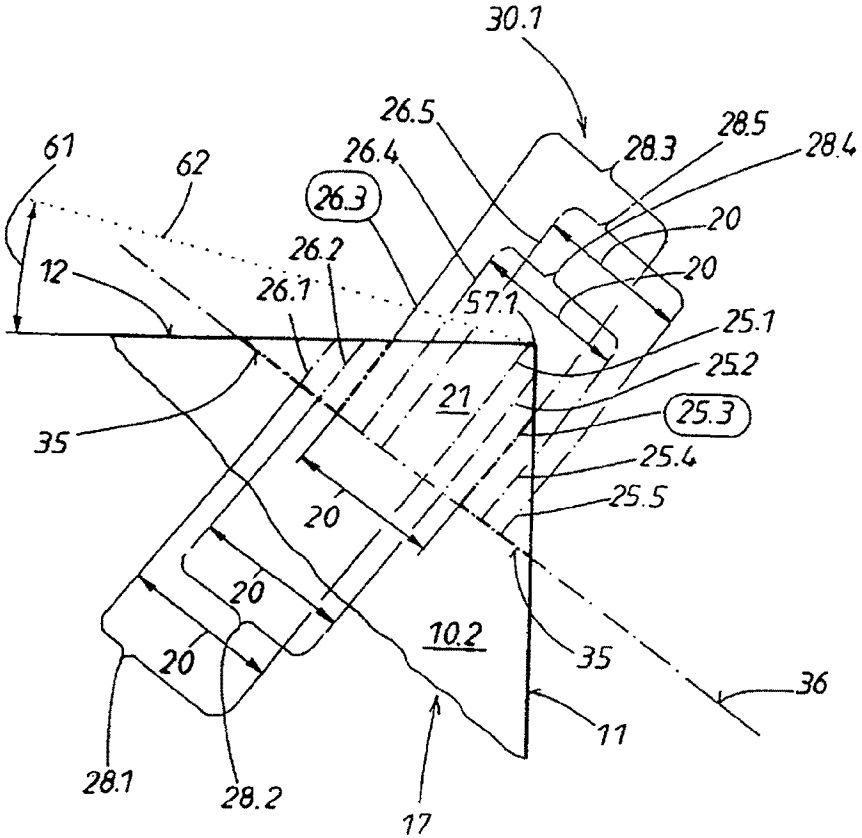
FIG. 2 is a schematic drawing of an enlarged corner region of the key bit shown in FIG. 1*a* or FIG. 1*b*, where variants for the formation of a code web are illustrated before the recesses necessary for this are produced.

FIG. 2 shows, with omission of the shading, the cross section of a corner region 30.1 between two flat lateral surfaces 11, 12 of the key bit 10.2. As illustrated in FIG. 3 by point shading, a recess 31, 32, which in the present case has an angular design, is cut into each lateral surface 11, 12. Therefore, the two recesses will be referred to as angular recesses 31, 32. The angular recesses 31, 32 have sides 34 that face each other, between which a web 21 is formed. The web flanks 25.1, 26.1 formed by the two angle sides 34 act as a pair of scanning points 15, 16 of the key bit 10.2, whose lateral position serves as code. Therefore, the web 21 can be referred to as the "code web". In the embodiment of FIGS. 2 and 3, the angular recesses 31, 32 are formed as right angles.

The keys 10.1, 10.2 described above are parts of a lock device, which also includes a lock cylinder 50, which is shown in FIG. 7*c*. FIG. 7*c* shows a cross section through a lock cylinder of this type, which consists of a stationary cylinder housing 51 and a cylinder core 52, which is rotatably supported therein. The cylinder core 52 is provided with a keyway 53, in which, in FIG. 7*c*, a third embodiment 10.3 of a key bit of the invention is inserted, which will be described in greater detail later in connection with FIGS. 6 to 10. The cylinder core 52 has chambers, in which spring-loaded tumblers 41 can move transversely to the key axis 27. Springs 54 act on a projection 38 of each tumbler 41. The linear movement of the tumblers 41 is illustrated by a double arrow 47.1 in FIG. 7*c*. If the key bit 10.3 were not inserted, the springs 54 would push the tumblers into blocking channels 55.1 or 55.2, thereby holding the cylinder core 52 in place so that it cannot turn in the cylinder housing 51. In the embodiment illustrated in FIG. 7*c*, the cylinder housing 51 has two additional blocking channels 56.1 and 56.2, into which, when the key is pulled out, the ends of another tumbler 42 at right angles to the illustrated tumbler 41 can enter. This will be described in greater detail in connection with FIGS. 6 and 7*a*.

Figure 4:
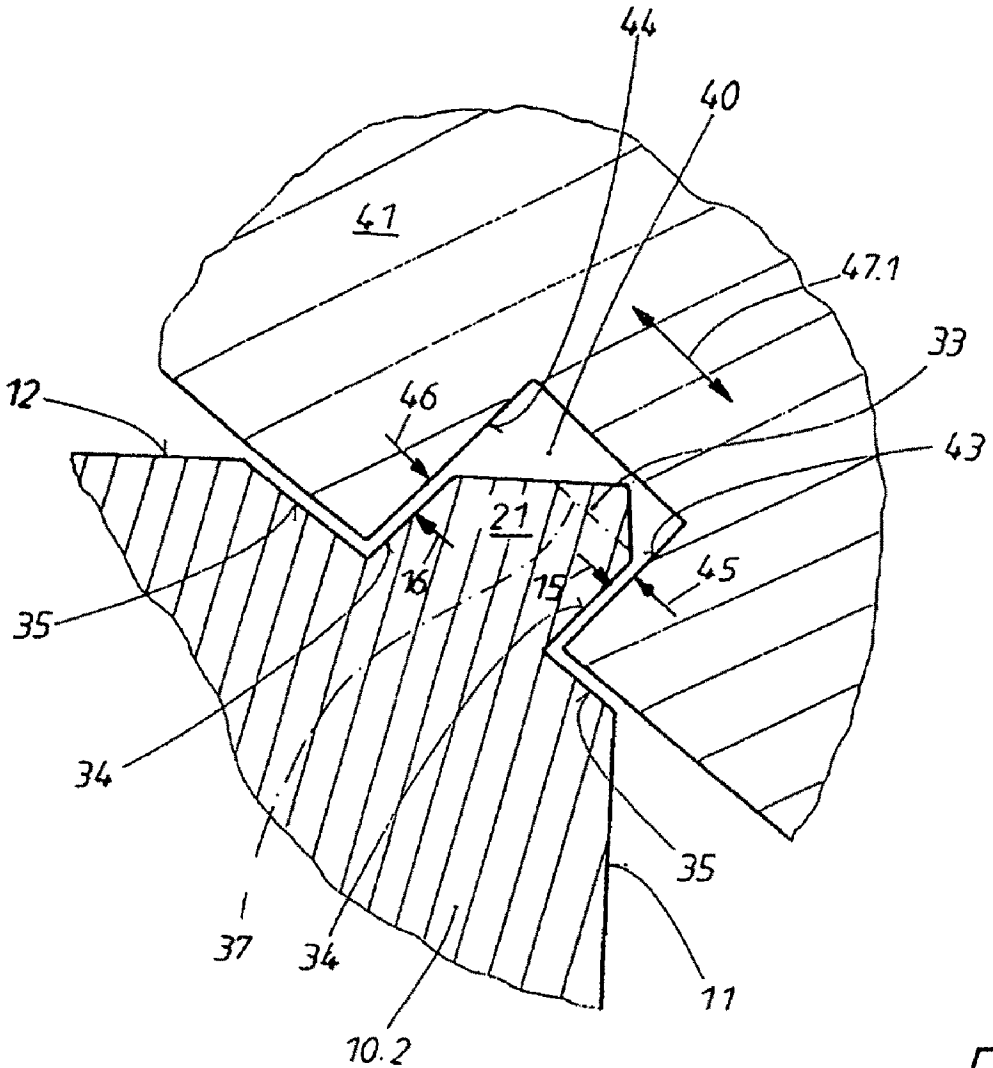
FIG. 4 shows a cross section through the lock device, which is analogous to the cross section shown in FIG. 3, and which shows, in addition to coding on the code web, the corresponding countercoding on an associated tumbler.

FIG. 4 shows in greater detail how a tumbler 41 of this type interacts with the inserted key bit 10.2. The aforementioned pair of scanning points 15, 16 on the sides of the code web 21 engages a pair of cooperating scanning points, which constitute a corresponding countercoding. This occurs by means of a cutout in the tumbler. The code web 21 fits into this cutout when the key is inserted. The edges 43, 44 of the cutout 40 form the two cooperating scanning points 45, 46.

As FIG. 5*a* shows, the tumbler 41 has a plate-like design and has a central opening 39, through which the key bit passes when the key is inserted. The cutout 40 borders on this central opening 39 and points in the same direction as the lateral projection 38, described above in connection with FIG. 7*c*, on which the spring 54 acts.

FIG. 5*b* shows a tumbler 41' that is an alternative to the tumbler 41 shown in FIG. 5*a*. The difference is that certain edges of the plate-like tumbler are beveled. The various beveled edges are labeled 48.1 to 48.5 in FIG. 5*b*. For example, first of all, beveled edges 48.1 and 48.2 are provided on the two aforementioned edges 43, 44 of the cutout 40. These beveled edges 48.1, 48.2 allow the shaft of the key to be threaded more easily through the opening 39 when the key is inserted into the keyway 53 of FIG. 7*c*.

If unauthorized persons wish to determine which coding is present in a given lock cylinder, they try to find out about the position of the edges 43, 44 of the cutout 40, which, as has been noted, are provided with bevels 48.1, 48.2 in the tumbler 41'. To make decoding more difficult for unauthorized persons, the coding can be "camouflaged" by providing additional beveled edges at 48.3 to 48.5. Between the two edges 43, 44 of the cutout 40, there is a connection between the two edges 43, 44 of the cutout 40, and the edge of this connection can also be provided with a suitable bevel 48.3. Finally, in FIG. 5*b*, the opening 39 has the edges 49.2 and 49.3 at the transition to the cutout 40. These edges 49.2 and 49.3 can also be provided with bevels 48.4 and 48.5.

FIG. 3 shows only an example of the position of a code point 28.3 of the code web 21. In the longitudinal direction of the key bit 10.3, there is a large number of additional scanning points, which are labeled 29.1 to 29.10 in FIG. 8. Naturally, to allow variation of the coding, the two web flanks are offset compared to FIG. 3 in successive sections of the respective code webs 21 to 24. The first code web 21, which is highlighted by coarse point shading in FIG. 8, is formed in this way in the key bit 10.3 shown there. The possible range of variation of the web flanks is illustrated in FIG. 2 by dot-dash lines 25.1 to 25.5 and 26.1 to 26.5—

In FIG. 2, five different code points 28.1 to 28.5 are provided, in which the position of the corresponding pair of web flanks 25.1, 26.1 to 25.5, 26.5 can vary. In this regard, the associated code web has an essentially constant web width 20 over the entire axial length of the key bit 10.2. Only in the case of large, immediately adjacent, increments will the code web be designed in some places with different web widths. FIG. 2 already shows a possible extreme position of a pair of scanning points 28.1, where both of the associated web flanks 25.1, 26.1 are in planes that extend past the edge 57.1 of the rectangular profile 17.

Similar extreme pairs of scanning points are also found in FIG. 8 in the code web 24 of the key bit 10.3 shown there. Ten axially spaced scanning points 29.1 to 29.10 are provided. In FIG. 8, the edge 57.1 of the rectangular profile 17' is replaced by a dot-dash line where the code web 21 crosses the edge 57.1. It is apparent that this occurs, e.g., at the scanning points 29.3 and 29.9.

As FIGS. 3 and 4 show, the facing sides 34 of the angular recesses located on the sides of the code web 21 are perpendicular to the direction of movement 47.1 of the tumbler 41 located there. Moreover, the two sides of the code web 21 are arranged parallel to each other. Naturally, it would also be conceivable that these angle sides 34 could be at a certain slant to the direction of movement 47.1. The web 21 would then have a trapezoidal cross section. In addition, the angle sides 34 are straight lines in FIGS. 3 and 4. An alternative to this would be for the sides 34 to be curved 70 (see FIG. 1), with either a convex 71 or a concave 72 curvature.

The other side 35 of the angle of FIG. 3 is essentially parallel to the direction of movement 47.1 of the associated tumbler 41. The two sides 34, 35 of the angle enclose a vertex angle, which in the present case, as has already been mentioned, is a right angle. As FIG. 2 shows, these other angle sides 35 lie in a common base plane 36. This base plane 36 intersects the corner region 30.1 obliquely. Alternatively, it would also be possible, at least in certain places, to arrange the two sides 35, which are located on opposite sides of a code web and which extend in the direction of movement of the tumbler 41, in such a way that they are vertically offset from each other.

In the present case, the variation of the position of the pairs of code points 28.1 to 28.5 of FIG. 2 occurs in the aforesaid common base plane 36. This base plane 36 determines the overall axial length of the corresponding key bit 10.1 to 10.3. Alternatively, it would be possible for a base plane of this type to have parts at different heights, at least in certain axial sections of the code webs.

As noted earlier, in both embodiments 10.1 and 10.2, the key bits have a rectangular profile 17. Alternatively, a hexagonal or octagonal profile can be used as the cross section. FIGS. 6 to 10 show a key bit 10.3 with a special edge profile 17', which can be referred to as a "prismatic profile" due to the following special design, which is apparent from FIG. 9.

As shown in FIG. 9, the prismatic profile 17' also has four active edges 57.1 to 57.4, which are used to create four code webs 21 to 24 according to FIG. 10. The difference from the preceding rectangular profile of FIGS. 1*b* to 4 is essentially that the second and fourth lateral surfaces 12', 14' form roof-like structures. This results in the formation of roof profile sections 60 between the edges 57.1 and 57.4, on the one hand, and 57.2 and 57.3, on the other hand. These roof profile sections 60 produce roof surfaces 58.1, 58.2 that are positioned at an angle to each other, one on each side of the associated vertex 59.1 and 59.2. This results in a more or less "hexagonal profile", which is irregular but exhibits folding symmetry, and whose two vertices 59.1 and 59.2 are not used for coding. The two roof profile sections 60 on the two opposing lateral surfaces 12', 14' are symmetrical to each other and have the advantage of increasing the ability to vary the arrangement of the pairs of code points 58.1 to 58.5, as can be made clear on the basis of FIGS. 2 and 9.

FIG. 9 shows that the roof surface 58.1 forms a roof angle 61 of about 15° to the edge 57.4. When this same angle 61 is drawn in with respect to the edge 57.1 in FIG. 2 as the dotted auxiliary line 62 shown in FIG. 2, it can be seen that additional key cross-sectional area is obtained in front of the first pair of code points 28.1, and this area can be used to achieve further variation of the coding. In terms of the coding to be carried out, the same situation exists at the other edge 57.1 shown in FIG. 9, where again additional area is provided by the roof surface 58.2 of the roof profile section 60. Even though the width of the web cross section is increased slightly by the flat roof profile sections 60, relatively large roof surfaces 58.1, 58.2 are obtained, which allow additional variation of the positions of the pairs of code points.

As FIGS. 6 to 10 show, in the third embodiment 10.3 of the key bit of the invention, all four edges 57.1 to 57.4 are provided with code webs 21 to 24, and code webs that lie opposite each other, as is shown especially well in FIG. 10, have identical coding, namely, 21, 23, on the one hand, and 22, 24, on the other hand. This key bit 10.3 constitutes a so-called "either-way key", which can be inserted in the keyway 53 of the cylinder core 52 in either of two positions 180° apart. In this device, as FIGS. 6 to 7*a* show, there are two types of tumblers 41, 42 with respect to their orientations in the cylinder core 52. The first type of tumbler 41 scans the pairs of code points along the code web 22, for example, while the other type of tumbler 42 interacts with the code web 23. In either of the "either-way" positions of the key, the two types of opposing code webs 24 to 21 will engage with the two types of tumblers 41 and 42.

As is shown especially well in FIGS. 6 and 7*b*, the two tumblers 41, 42 are angularly offset from each other, with the offset angle corresponding to the angular offset of the associated code webs 22, 23. In the present case, it is a 90° angle. As illustrated by arrows 47.1 and 47.2, the directions of movement 47.1, 47.2 of the two types of tumblers 41, 42 are also arranged at an angle to each other, which in this case is 90°. Moreover, the two types of tumblers 41, 42 alternate with each other in the cylinder core 52, which means that two adjacent tumblers 41, 42 will move longitudinally in different directions in the keyway 53.

As illustrated in dot-dash line in FIG. 4, one of the edge regions 33 can be cut away, as illustrated at 37. This saves space, because the associated cutout 40 in the tumbler 41 does not have to be as deep. This does not adversely affect the size of the crucial scanning points 15, 16 on both sides of the code web 21 of the key bit 10.2. Instead of a cutaway 37 of this type, the edge could also be rounded 73 in the corner region.

LIST OF REFERENCE NUMBERS

10.1 first key bit with a code web (FIG. 1*a*)
10.2 second key bit with four code webs (FIGS. 1*b* to 4)
10.3 third key bit with prismatic profile (FIGS. 6 to 10)
11 first lateral surface of 10.2 (FIGS. 1*a* to 4)
12 second lateral surface of 10.2 (FIGS. 1*a* to 4)
12' second lateral surface of 10.3 (FIG. 9)
13 third lateral surface of 10.2 (FIGS. 1*a* to 4)
14 fourth lateral surface of 10.2 (FIGS. 1*a* to 4)
14' fourth lateral surface of 10.3 (FIG. 9)
15 first scanning point on 11 (FIGS. 3, 4)
16 second scanning point on 11 (FIGS. 3, 4)
17 edge profile, rectangle (FIGS. 1*a* to 4)
17' edge profile, prismatic profile of 10.3 (FIGS. 6 to 10)
18 width of 10.1 (FIG. 1*a*)
19 height of 10.1 (FIG. 1*a*)
20 web width (FIG. 2)
21 first code web at 30.1 (FIG. 1*b*)
22 second code web at 30.2 (FIG. 1*b*)
23 third code web at 30.3 (FIG. 6)
24 fourth code web at 30.4 (FIG. 1*b*)
25.1 first web flank of 21 at 28.1 (FIG. 2)
25.2 first web flank of 21 at 28.2 (FIG. 2)
25.3 first web flank of 21 at 28.3 (FIG. 2)
25.4 first web flank of 21 at 28.4 (FIG. 2)
25.5 first web flank of 21 at 28.5 (FIG. 2)
26.1 second web flank of 21 at 28.1 (FIG. 2)
26.2 second web flank of 21 at 28.2 (FIG. 2)
26.3 second web flank of 21 at 28.3 (FIG. 2)
26.4 second web flank of 21 at 28.4 (FIG. 2)
26.5 second web flank of 21 at 28.5 (FIG. 2)
27 key axis of 10.3 (FIGS. 6, 7*c*, 8)
28.1 first pair of code points, first code point (FIG. 2)
28.2 second pair of code points, second code point (FIG. 2)
28.3 third pair of code points, third code point (FIG. 2)
28.4 fourth pair of code points, fourth code point (FIG. 2)
28.5 fifth pair of code points, fifth code point (FIG. 2)
29.1 first scanning point (FIG. 8)
29.2 second scanning point (FIG. 8)
29.3 third scanning point (FIG. 8)
29.4 fourth scanning point (FIG. 8)
29.5 fifth scanning point (FIG. 8)
29.6 sixth scanning point (FIG. 8)
29.7 seventh scanning point (FIG. 8)
29.8 eighth scanning point (FIG. 8)
29.9 ninth scanning point (FIG. 8)
29.10 tenth scanning point (FIG. 8)
30.1 first corner region of 10.2 (FIGS. 1*b*, 2)
30.2 second corner region of 10.2 (FIG. 1*b*)
30.3 third corner region of 10.2 (FIG. 1*b*)
30.4 fourth corner region of 10.2 (FIG. 1*b*)
31 first angular recess in 11 (FIG. 3)
32 second angular recess in 12 (FIG. 3)
33 cutaway edge region in 21 (FIG. 4)
34 first side of the angle of 31, 32 (FIG. 3)
35 second side of the angle of 31, 32 (FIG. 3)
36 base plane of 35 (FIG. 2)
37 cutting line for 33 (FIG. 4)
38 projection of 41 (FIG. 5*a*)
39 opening in 41 or 41' (FIG. 5*a*)
40 cutout in 41, 41', 42 (FIGS. 4, 5*a*, 5*b*; 7*a*, 7*b*)
41 tumbler (FIGS. 4, 5 to 7*b*)
41' tumbler (FIG. 5*b*)
42 tumbler (FIGS. 6, 7*b*)
43 first edge of the cutout 40 (FIG. 4)
44 second edge of the cutout 40 (FIG. 4)
45 first cooperating scanning point of 41 at 40 (FIG. 4)
46 second cooperating scanning point of 41 at 40 (FIG. 4)
47.1 direction of movement of 41 (FIGS. 4, 6 to 7*c*)
47.2 direction of movement of 42 (FIGS. 6, 7*b*)
48.1 beveled edge at 43 (FIG. 5*b*)
48.2 beveled edge at 44 (FIG. 5*b*)
48.3 beveled edge at 29.1 [sic—49.1] (FIG. 5*b*)
48.4 beveled edge at 29.3 [sic—49.3] (FIG. 5*b*)

48.5 beveled edge at 29.2 [sic—49.2] (FIG. 5*b*)
49.1 connection between 43, 44 (FIG. 5*b*)
49.2 first edge of 39 at 40 (FIG. 5*b*)
49.3 second edge of 39 at 40 (FIG. 5*b*)
50 lock cylinder (FIG. 7*c*)
51 stationary cylinder housing (FIG. 7*c*)
52 cylinder core in 51 (FIG. 7*c*)
53 keyway in 52 (FIG. 7*c*)
54 spring for 41 (FIG. 7*c*)
55.1 first blocking channel for 41 (FIG. 7*c*)
55.2 second blocking channel for 41 (FIG. 7*c*)
56.1 first blocking channel for 42 (FIG. 7*c*)
56.2 second blocking channel for 42 (FIG. 7*c*)
57.1 first edge of 17; 17' (FIGS. 8 to 10)
57.2 second edge of 17; 17' (FIGS. 8 to 10)
57.3 third edge of 17; 17' (FIGS. 8 to 10)
57.4 fourth edge of 17; 17' (FIGS. 8 to 10)
58.1 first roof surface of 60 (FIG. 9)
58.2 second roof surface of 60 (FIG. 9)
59.1 first vertex of 60 (FIG. 9)
59.2 second vertex of 60 (FIG. 9)
60 roof profile section at 17' (FIG. 9)
61 roof angle of 60 (FIGS. 9, 2)
62 auxiliary line for 61 (FIG. 2)
63 angle between 47.1, 47.2 (FIG. 7*b*)
70 curved line
71 convex shape
72 concave shape
73 rounded edge

The invention claimed is:

1. A lock device with a lock cylinder (50), which comprises of a stationary cylinder housing (51) and a cylinder core (52) rotatably supported therein, and with a key bit (10.1, 10.2, 10.3), which has an edge profile (17) and can be inserted into a keyway (53) in the cylinder core (52) in order to sort tumblers (41, 42), which can move transversely to it, in the cross section of the cylinder core (52), where a pair of scanning points (15, 16) for coding the key bit (10.1, 10.2, 10.3) is provided for each, tumbler (41, 42) by means of a profiled recess (31, 32), which extends in the longitudinal direction of the key bit (10.1, 10.2, 10.3), and a pair of cooperating scanning points (45, 46) is provided on each tumbler (41, 42) to provide a corresponding countercoding, wherein one (15) of the two scanning points (15, 16) of a first recess (31) is located in one of the lateral surfaces (11) of the edge profile (17) of the key bit (10.2), while the other scanning point (16) of a second recess (32) is located in the adjacent lateral surface (12) of the edge profile (17); in that a web is left in the corner region (30.1) of the edge profile (17) of the key bit (10.1, 10.2, 10.3) located between the two recesses (31, 32); in that the web acts as a code web (21 to 24), because opposite web flanks (25.3, 26.3) of the code web (21) produce the pair of scanning points (15, 16) of the key bit (10.1, 10.2) that serves for coding; in that each of the tumblers (41, 42) is provided with a cutout (40), which in use encloses the opposing web flanks (25.3, 26.3) of the code web (21 to 24); and in that the lateral edges (43, 44) of the cutout (40) constitute the cooperating scanning points (45, 46) in the tumblers (41, 42).

2. A lock device according to claim 1, wherein, to allow variation of the position of the pair of scanning points (15, 16) in successive sections of the code web (21 to 24), the two web flanks (25.3, 26.3) on the code web (21 to 24) are laterally offset from each other.

3. A lock device according to claim 2, wherein, as part of the variation of the positions of the pairs of scanning points (15, 16), both web flanks (25.1, 26.1) of the code web (21) are in planes that extend beyond the given edge (57.1) of the edge profile (17) of the key bit (10.2) in the area of at least one code point (28.1), thus producing an extreme pair of scanning points (28.1) (29.1) here, and in that in the area of this extreme pair of scanning points (29.1), the code web (21) extends only along one (12) of two lateral flanks (11, 12) of the edge profile (17) of the key bit (10.2).

4. A lock device according to claim 1, wherein the code web (21 to 24) has an essentially constant web width (20) over its entire axial length.

5. A lock device according to claim 1, wherein the code web (21 to 24) has different web widths at least in certain places.

6. A lock device according to claim 1, wherein several corner regions (30.1 to 30.4) of the edge profile (17) of the key (10.2) are provided with a code web (21 to 24).

7. A lock device according to claim 6, wherein all of the corner regions (10.1 to 10.4) of the edge profile (17) of the key (10.2) act as code webs (21 to 24).

8. A lock device according to claim 6, wherein the code webs (21 to 24) have different coding from each other in different corner regions (30.1 to 30.4).

9. A lock device according to claim 6, wherein at least some code webs (22, 24 and 21, 23) have the same coding.

10. A lock device according to claim 1, wherein the edge profile (17') of the key bit (10.3) has similarly coded code webs (21, 23; 22, 24) in two opposite positions.

11. A lock device according to claim 10, wherein the similarly coded code webs (21, 23 and 22, 24) make the key bit (10.3) an "either-way key", which can be inserted into the keyway (53) of the lock cylinder (50) in either of two opposite positions.

12. A lock device according to claim 1, wherein tumblers (41, 42), which are arranged in the cylinder core (52) of the lock cylinder (50) a certain axial distance apart from each other, act on code webs (21 to 24) in the edge profile (17; 17') of the key bit (10.1, 10.2; 10.3) that are circumferentially offset from one another, and in that the respective directions of movement (47.1, 47.2) of these tumblers (41, 42) during the insertion and removal of the key bit (10.1, 10.2; 10.3) are at an angle (63) to each other that corresponds to the angular position of the associated code webs (21 to 24).

13. A lock device according to claim 12, wherein adjacent tumblers (41, 42) in the lock cylinder (50) move in different directions (47.1, 47.2) in the cylinder core (52).

14. A lock device according to claim 12, wherein the angle (63) between the two directions of movement (47.1, 47.2) of adjacent tumblers (41, 42) is a right angle) (90°).

15. A lock device according to claim 1, wherein, as seen in a cross section through the key bit (10.2), each of the two recesses (31, 32) in adjacent lateral surfaces (11, 12) of the edge profile (17) is formed as an angle and constitutes an angular recess (31, 32), and in that the facing angle sides (34) of the two angular recesses (31, 32) form the pair of scanning points (15, 16) that serve for coding.

16. A lock device according to claim 15, wherein the angle sides (34) of the two angular recesses (31, 32), which sides serve for the coding (15, 16), extend transversely to the direction of movement (47.1) of the associated tumblers (41) in the cylinder core (52) of the lock cylinder (50).

17. A lock device according to claim 16, wherein the two angle sides (34, 35) of an angular recess (31; 32) are essentially perpendicular to the direction of movement (47.1) of the associated tumbler (41).

18. A lock device according to claim 16, wherein at least one of the two angle sides is essentially at a slant to the direction of movement (47.1) of the associated tumbler (41).

19. A lock device according to claim 15, wherein the angle side (34) of each of the angular recesses (31, 32) or the associated edge (43, 44) of the cutout (40) in the tumbler (41) is designed essentially as a straight line.

20. A lock device according to claim 15, wherein the angle side (34) of each of the angular recesses (31, 32) and/or or the associated edge (43, 44) of the cutout (40) in the tumbler (41) is designed essentially as a curved line.

21. A lock device according to claim 20, wherein the curvature is convex.

22. A lock device according to claim 20, wherein the curvature is concave.

23. A lock device according to claim 15, wherein the an other side (35) of the angular recess (31, 32) extends essentially in the direction of movement (47.1) of the associated tumbler (41).

24. A lock device according to claim 17, wherein the two angle sides (34, 35) of an angular recess (31; 32) enclose a vertex angle between them, which faces the axis (27) of the key bit (10.1, 10.2).

25. A lock device according to claim 24, wherein the vertex angle is a right angle.

26. A lock device according to claim 15, wherein analogous angle sides (35), which are located in corresponding angular recesses (31, 32) on the two sides of the code web (21) and extend essentially in the direction of movement (47.1) of the associated tumblers (41), lie in a common base plane (36), and in that this base plane (36) obliquely intersects the corner region (30.1) of the edge profile (17) of the key bit (10.2).

27. A lock device according to claim 26, wherein the analogous sides of angles located on the two sides of the code web are vertically offset relative to each other, at least in certain places.

28. A lock device according to claim 26, wherein the base plane is the same along the entire axial length of the code web (21 to 24).

29. A lock device according to claim 26, wherein the base plane is located at different heights in at least certain axial sections of the code web.

30. A lock device according to claim 1, wherein the edge profile (17) of the key bit is a rectangle.

31. A lock device according to claim 30, wherein the width (18) of the edge profile (17) is different from the height (19) of the edge profile (17).

32. A lock device according to claim 1, wherein the edge profile is a hexagon.

33. A lock device according to claim 1, wherein, as seen in the profile cross section of the key bit (10.3), one of the lateral surfaces (12', 14') of the edge profile (17') forms a roof-like structure, creating a roof profile section (60), and in that as part of the variation of the code, the recess (31; 32) in this roof profile section (60) can extend over both of the roof surfaces (58.1, 58.2) which are positioned at an angle to each other.

34. A lock device according to claim 33, wherein the roof profile section (60), which produces a lateral surface (12', 14') in the edge profile, has flat roof surfaces (58.1, 58.2).

35. A lock device according to claim 1, wherein an edge in the edge profile or in the corner region provided there is rounded.

36. A lock device according to claim 1, wherein the edge (57.1) in the edge profile (17) or in the corner region (30.1 to 30.4) provided there, is cut away (33).

37. A lock device according to claim 1, wherein the lateral edges (43, 44) of the cutout (40) in the tumblers)(41') are beveled.

38. A lock device according to claim 37, wherein the edge of the connection (49.1) between opposite edges (43, 44) of the tumbler cutout (40) is provided with a bevel (48.3).

39. A lock device according to claim 37, wherein, adjacent to the cutout (40) that serves for the countercoding, one of the tumblers (41') has a central opening (39) for the key bit, and in that at least one of the edges (49.2, 49.3) of the opening (39) which proceeds from one of the two edges (43, 44) of the cutout (40) that serve for the countercoding is beveled.

* * * * *